US010450188B2

(12) United States Patent
Debes et al.

(10) Patent No.: US 10,450,188 B2
(45) Date of Patent: Oct. 22, 2019

(54) SAFETY LOCK FOR WELDING/MOUNTING ONTO STIRRUPS

(71) Applicant: Sp/f 1. februar 2015, Oyrarei (FO)

(72) Inventors: Uni Debes, Tórshavn (FO); Jóannes Debess, Oyrareingi (FO); Marner Joensen, Kollafjørður (FO)

(73) Assignee: Sp/f 1. februar 2015, Oyrarei (FO)

( * ) Notice: Subject to any disclaimer, the term of this patent is extended or adjusted under 35 U.S.C. 154(b) by 268 days.

(21) Appl. No.: 15/561,620

(22) PCT Filed: Mar. 18, 2016

(86) PCT No.: PCT/DK2016/050080
§ 371 (c)(1),
(2) Date: Sep. 26, 2017

(87) PCT Pub. No.: WO2016/155742
PCT Pub. Date: Oct. 6, 2016

(65) Prior Publication Data

US 2018/0072558 A1 Mar. 15, 2018

(30) Foreign Application Priority Data

Mar. 27, 2015 (DK) ..... 2015 00195

(51) Int. Cl.
*B68C 1/18* (2006.01)

(52) U.S. Cl.
CPC ..... *B68C 1/18* (2013.01)

(58) Field of Classification Search
CPC ..... B68C 1/18; B68C 1/16; B68C 2003/0058
See application file for complete search history.

(56) References Cited

U.S. PATENT DOCUMENTS

| | | | |
|---|---|---|---|
| 734,960 | A | 7/1903 | Rosenfeld |
| 4,680,921 | A | 7/1987 | Bezin |
| 4,995,226 | A | 2/1991 | Kuhn |
| 6,898,924 | B1 | 5/2005 | McCoy |
| 2004/0011009 | A1 | 1/2004 | Barnes |

FOREIGN PATENT DOCUMENTS

| | | | |
|---|---|---|---|
| CH | 372211 | A | 9/1963 |
| CN | 201077761 | Y | 6/2008 |
| CN | 103011046 | A | 4/2013 |
| GB | 20310 | | 9/1909 |
| GB | 04510 | | 2/1910 |
| GB | 624654 | A | 6/1949 |
| WO | 9743205 | A1 | 11/1997 |

*Primary Examiner* — Kristen C Hayes
(74) *Attorney, Agent, or Firm* — James Creighton Wray

(57) ABSTRACT

Safety lock for welding/mounting on stirrups. A safety lock to be welded or mounted on stirrups where the stirrup strap is to hang on a support bar within a pin and within a rocker arm on a bearing face, supported by support arms. The safety lock keeps the stirrup secure in the strap during riding, but will release the strap such that the stirrup is loosened and falls off the strap if the rider falls off the horse and stays hanged by the stirrup.

3 Claims, 7 Drawing Sheets

SAFETY LOCK FOR WELDING/MOUNTING ONTO STIRRUPS

The invention concerns a safety lock or safety mechanism for welding or mounting on stirrups for holding the stirrup strap secure in the stirrup, however at the same time capable of releasing the strap if the rider falls off the horse.

The lock/mechanism is of the kind adapted with two support arms holding the strap together and a support beam on which the strap hangs centrally under the support arms.

The stirrup strap is to lie down around the support beam and up between the support arms and is by means of the support arms held right up over the support beam and kept in position on the support beam by a pin at the free/open end at the side of the support beam. Below the support beam is provided a spring loaded rocker arm that will push the strap in place again if it should slide a little beyond the pin when the stirrup is not loaded.

The lock is made of stainless steel or other suitable material, one at each side of the horse. What is intended for the left side of the horse marked by an L (left) and with an arrow showing the direction forward. In the same way, the lock on the right side of the horse marked by an R (right) and with an arrow showing the direction forward.

By the prior art, stirrups as disclosed in U.S. Pat. No. 4,680,921 A 1 (BENZIN) 21 Jul. 1987, the safety lock is mounted on a stirrup during use and fastened by a stirrup strap to a saddle, the safety lock securing the stirrup to the stirrup strap while riding such that the stirrup is loosened and falls off the stirrup strap if a rider falls off the horse and hangs on by the stirrup.

By the invention is provided a safety lock of the kind indicated in the introduction which keeps the stirrup secure in the strap during riding, but can release the strap such that the stirrup is loosened and falls off the strap if the rider falls off the horse and stays hanged by the stirrup.

According to the invention, this is achieved by a safety lock of the kind mentioned in the introduction which is characterised in that the stirrup strap hanging on the support beam and supported by the support arms slides out of the lock when the rider falls off the horse, irrespectively of how the rider falls off. The essential feature in this connection is the length of the support arms where the innermost is shorter, the pin on the support beam which is only on the outer side, and the distance between the support beam and the surface under the support beam.

The support beam on the lock is provided with a small pin in the leading edge at the outer side, which together with the rocker arm cause the strap to hang in place during all kinds of riding, or if the rider walks by the horse, the stirrup will hang as it should. According to the invention, however, a rider will be released from the strap and the horse if he falls off, irrespectively of how the rider falls and irrespectively how the horse reacts.

The lock operates in the way that when a rider falls off the horse, his own weight will contribute to a change of the axis of the stirrup, meaning that if the stirrup tilts backwards or the strap is forced forwards, the strap will slide off the support beam, and the rider is released from the horse together with the stirrup, without the pin on the support beam, the support arms or the rocker arm preventing this, and by means of the surface under the support beam. When the rider falls off the horse, the shoe or riding boot of the rider will not prevent the strap from sliding off, this will be provided for by the support beam and the protection of the rocker arm, and the same is provided for by the protector of the rocker arm.

In a particular embodiment of the lock, an indentation can be made in the rocker arm opposite the stopper for the rocker arm, at the same time making a small indentation in the stopper for the rocker arm, then making a groove between support beam and protection for rocker arm and protector for rocker arm, then making a rounded indentation in the surface below the support beam. A rubber ring or O-ring, which keeps the rocker arm in place, is fitted into these indentations or depressions. No spring or spring pin is provided in these locks.

The invention is explained more closely in the following with reference to the drawings, where

DETAILED DESCRIPTION

Figure 1:
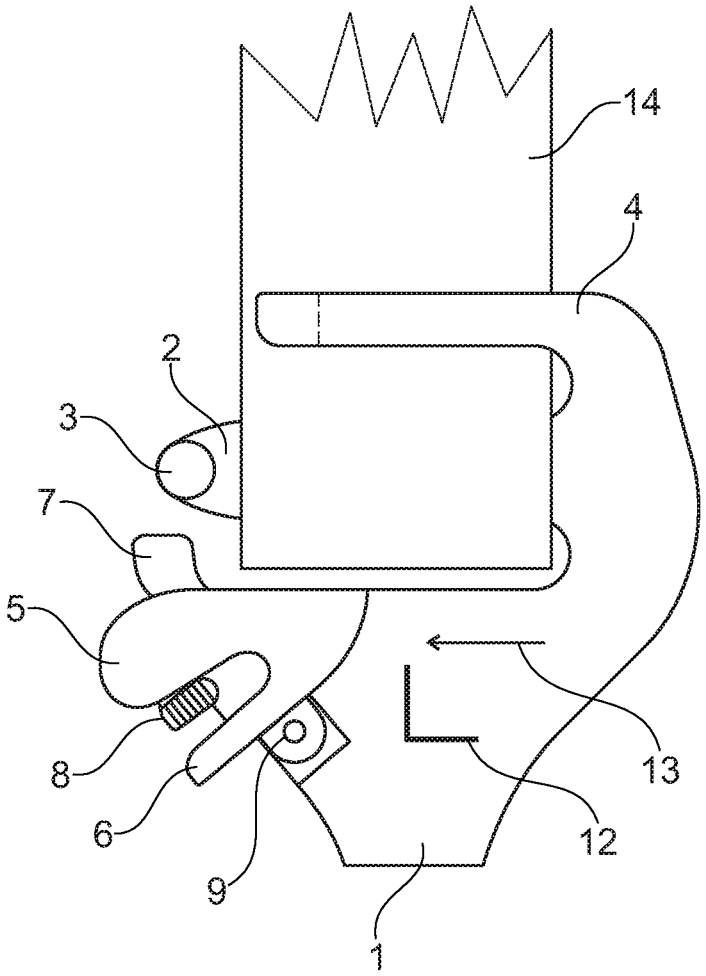
FIG. 1 shows a safety lock according to the invention as seen from outside at the left side with stirrup strap mounted thereon.

FIG. 1 shows a safety lock 1 with stirrup strap 14 mounted thereon. The stirrup strap hangs on the support beam 2 within the pin 3, and the rocker arm 7 on the bearing/sliding face 16, supported by support arms 4. We see support beam and protection 5 for rocker arm, protector 6 for rocker arm, stopper 8 for rocker arm, and we see pin 9 for hinging the rocker arm. Also, we see an L 12 which stands for left, and an arrow for indicating forward direction 13.

Figure 2:
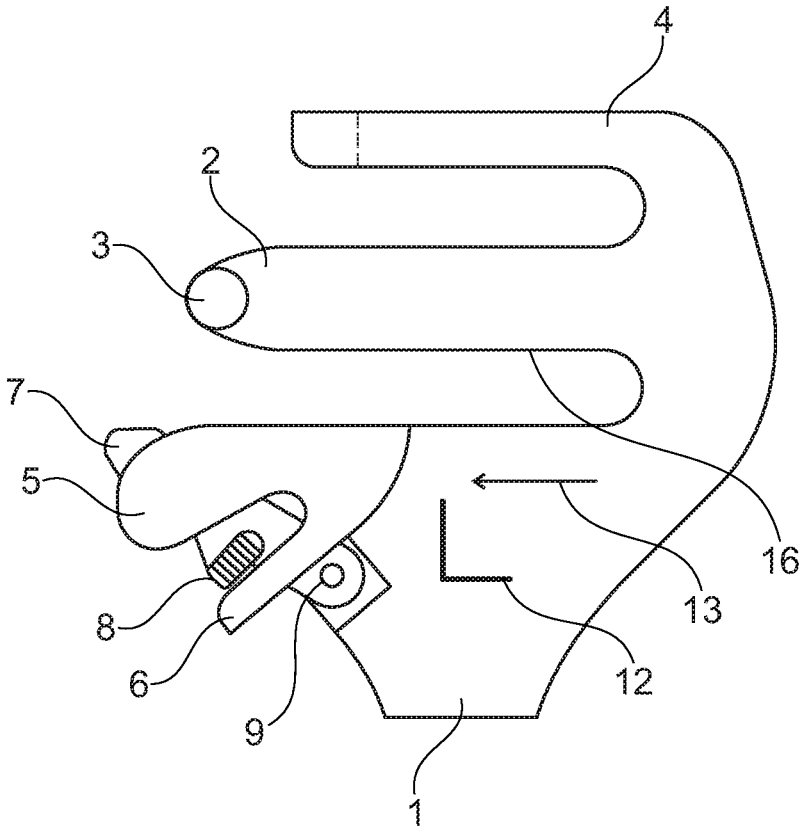
FIG. 2 shows a safety lock as seen from outside at the left side without stirrup strap, but with open rocker arm.

FIG. 2 shows the same but without stirrup strap and with open rocker arm.

Figure 3:
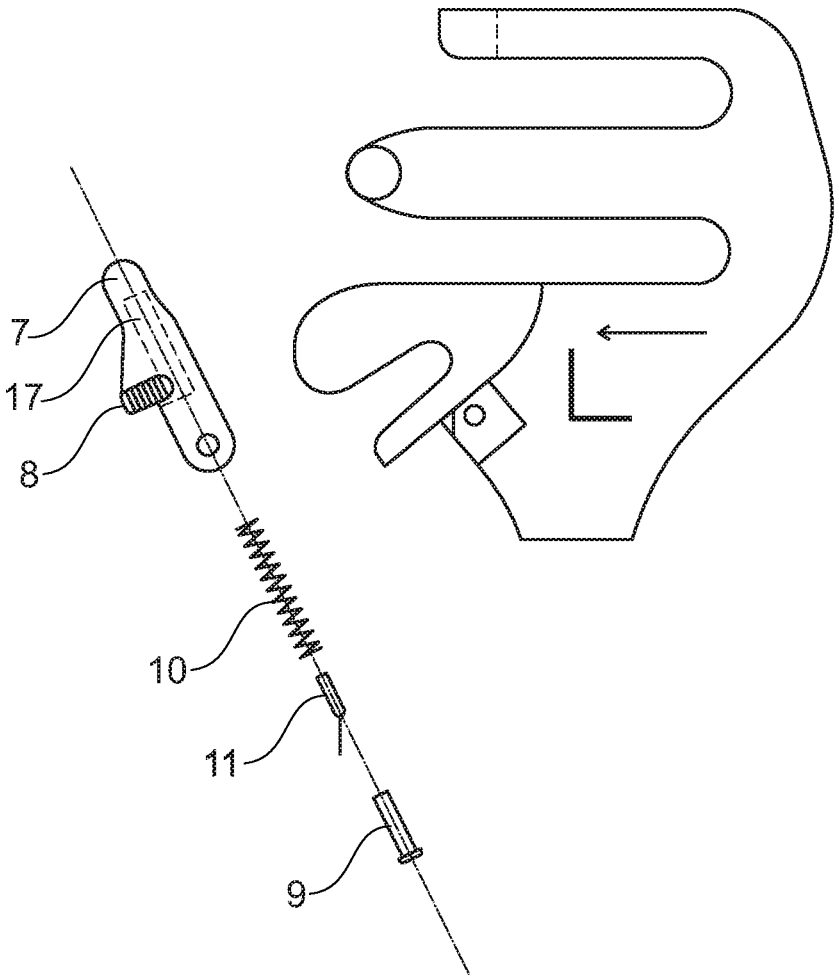
FIG. 3 shows a safety lock as seen from outside at the left side in disassembled condition, where all movable parts can be seen.

FIG. 3 shows the same, but disassembled. Here we see rocker arm 7 as well as spring 10, hole 17 for spring, spring pin 11 and pin 9 for hinging the rocker arm.

Figure 4:
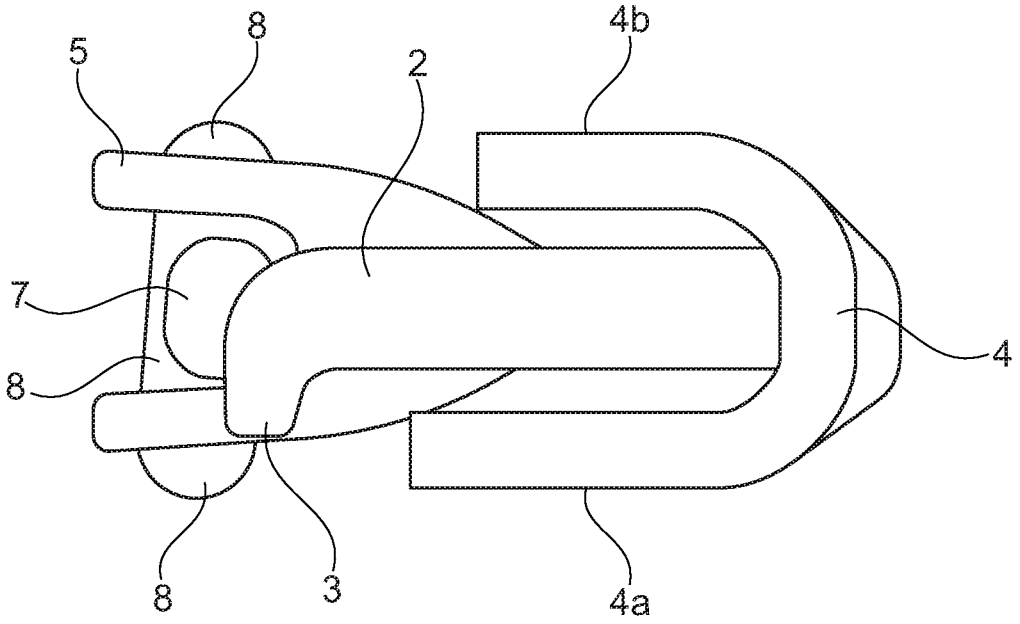
FIG. 4 shows a safety lock as seen from above.

FIG. 4 shows a safety lock as seen from above. Here we can look down on the support arm 4*a* and 4*b*, and we can see that one is shorter at the inside. We can look down on the support beam 2 that it only has a pin 3 at the outer side. We can look down on support beam and protection 5 for rocker arm, rocker arm 7 and on stopper 8 for rocker arm.

Figure 5:
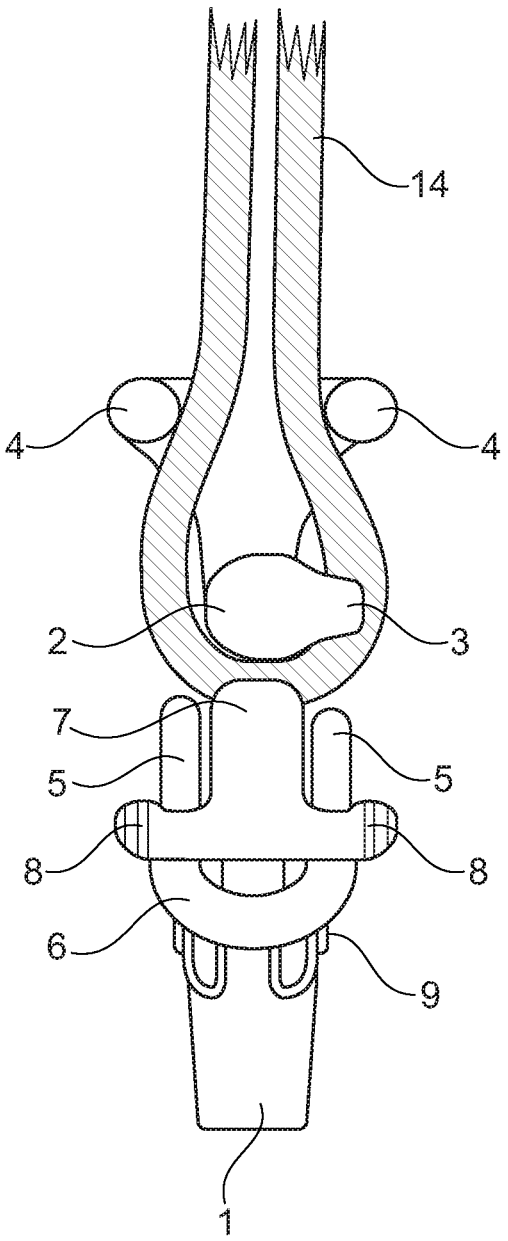
FIG. 5 shows a safety lock as seen from the front side, with fitted stirrup strap.

FIG. 5 shows a safety lock as seen from the front side, with fitted stirrup strap 14. It appears that the strap hangs on the support beam 2 behind the pin 3, behind rocker arm 7 and within the support arms 4. We can also see that the pin 3 is only at the outer side of the support beam 2.

Figure 6:
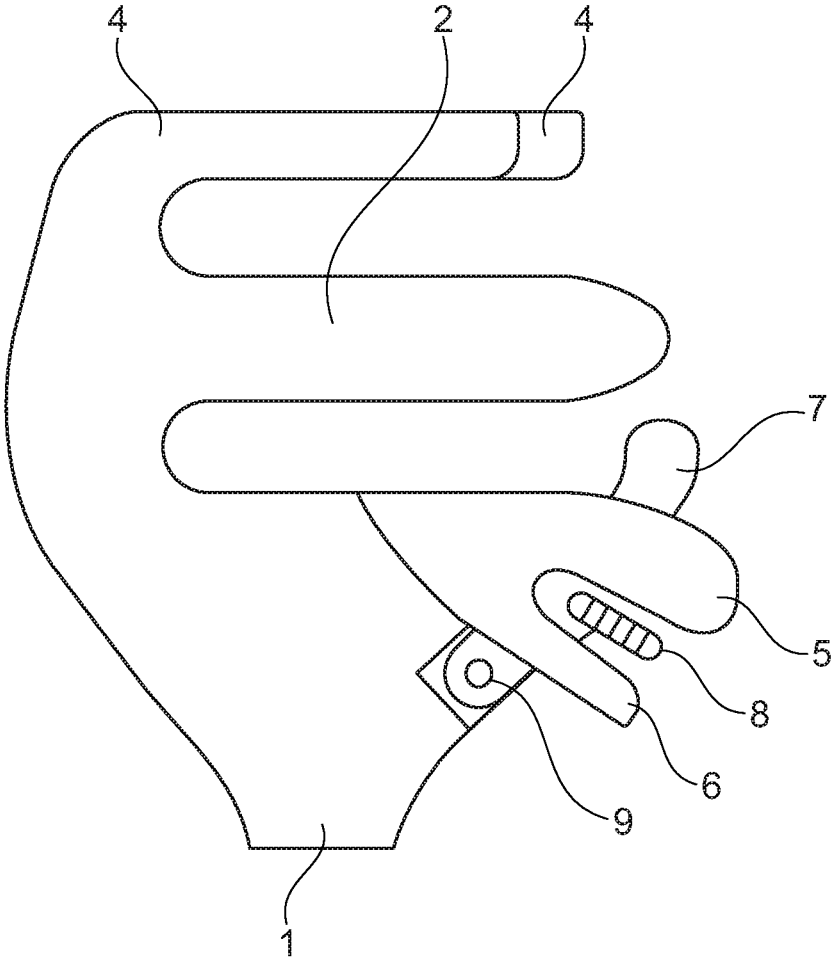
FIG. 6 shows a safety lock as seen from the inside at the left side.

FIG. 6 shows a safety lock as seen from the inside at the left side. Here we can see that the support arm 4 is shorter at the inner side. We see that the support beam 2 does not have any pin at the inside. We also see that rocker arm 7, support beam and protection 5 for rocker arm, protector 6 for rocker arm and stopper for rocker arm 8.

Figure 7:
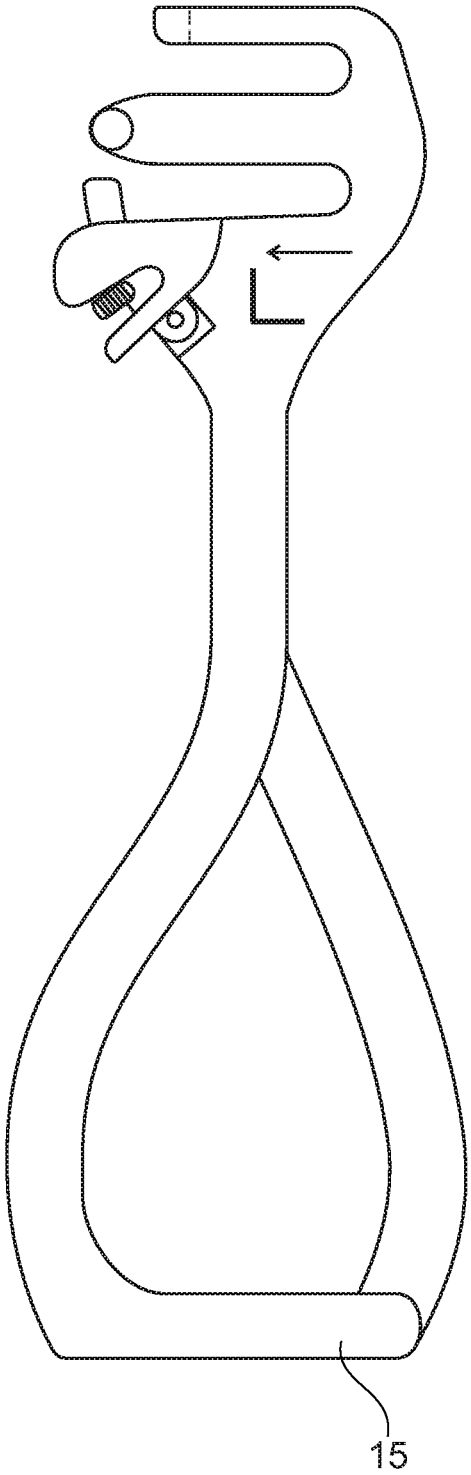
FIG. 7 shows a safety lock as seen from outside at the left side welded on a stirrup strap, as seen from the side.

FIG. 7 shows a safety lock welded onto a stirrup. We look on the outer side of the left side. The left safety lock is intended for left side of the horse. The safety lock at the right side of the horse is identical with the one at the left side, however reversed. On that lock an R is provided, meaning right side of the horse.

LIST OF DESIGNATIONS

1. safety lock for welding/mounting on stirrups
2. support beam for stirrup strap
3. pin holding the strap in place
4. support arms for stirrup strap
5. support beam and protection for rocker arm
6. protector/protection for rocker arm
7. rocker arm
8. stopper for rocker arm
9. pin for hinging rocker arm
10. spring
11. spring pin
12. L (left) indication side direction
13. arrow indicating forward direction
14. strap
15. stirrup welded on safety lock
16. bearing/sliding face
17. hole in rocker arm for spring

The invention claimed is:

1. A safety lock (1) for a stirrup (15), wherein the safety lock (1) during use is mounted on a stirrup (15) and fastened by a stirrup strap (14) to a saddle, the safety lock (1) securing the stirrup (15) to the stirrup strap (14) while riding such that the stirrup (15) is loosened and falls off the stirrup strap (14) if a rider falls off the horse and hangs by the stirrup (15), wherein the safety lock (1) is designed such that the stirrup strap is suspended on a bearing/sliding face (16) on a horizontal support beam (2) within a horizontal pin (3) disposed at one end of the support beam (2), and within a rocker arm (7) hinged to the safety lock (1) disposed below the support beam (2) and supported by two support arms (4), one at the outer side (4*a*) and a shorter one at the inner side (4*b*), both disposed above the support beam (2), the safety lock (1) also including a support beam (5) simultaneously acting as protection for the rocker arm (7) and a protector (6) for the rocker arm (7), and a stopper (8) for the rocker arm (7), where the rocker arm (7) is hingedly connected to the safety lock (1).

2. A safety lock according to claim 1, wherein the safety lock is designed with a pin (9), and the rocker arm (7) is spring loaded by a spring (10) and a spring pin (11) acting between the safety lock (1) and the rocker arm (7), the spring (10) mounted in a hole (17) in the rocker arm (7).

3. A safety lock according to claim 1, wherein the rocker arm is spring loaded by a rubber ring/O-ring, where there is an indentation in the rocker arm (7) opposite the stopper (8) for the rocker arm (7), at the same time there is a small indentation in the stopper (8) for the rocker arm (7) and a groove between support beam and protection (5) for the rocker arm (7) and protector (6) for the rocker arm (7), and a rounded indentation in the surface below the support beam (2), where into these indentations there is fitted a rubber ring/O-ring retaining the rocker arm (7) in position.

* * * * *